US005869924A

United States Patent [19]

Kim

[11] Patent Number: 5,869,924

[45] Date of Patent: Feb. 9, 1999

[54] CATHODE STRUCTURE AND CRT ELECTRON GUN ADOPTING THE SAME

[75] Inventor: Sang-kyun Kim, Seoul, Rep. of Korea

[73] Assignee: Samsung Display Devices Co., Ltd., Kyungki-do, Rep. of Korea

[21] Appl. No.: 889,508

[22] Filed: Jul. 8, 1997

[30] Foreign Application Priority Data

Jul. 8, 1996 [KR] Rep. of Korea ..... 1996-27531
Jul. 8, 1996 [KR] Rep. of Korea ..... 1996-27532

[51] Int. Cl.[6] ..... H01J 29/46

[52] U.S. Cl. ..... 313/446; 313/270; 313/346 R

[58] Field of Search ..... 313/412, 414, 313/446, 447, 270, 346 R, 309, 336

*Primary Examiner*—Vip Patel
*Attorney, Agent, or Firm*—Lowe Hauptman Gopstein Gilman & Berner

[57] ABSTRACT

A cathode structure and an electron gun for a CRT adopting the same are provided. The cathode structure has an external case, an insulating member filled in the external case, a plurality of pins fixedly inserted into the insulating member and of which end portions extend from the upper surface of the insulating member, a field emission device (FED) unit attached on the insulating member, and a wire for electrically connecting the FED unit to the end portions of the pins. Electrons are emitted by a field effect rather than by thermal electron emission.

14 Claims, 6 Drawing Sheets

CATHODE STRUCTURE AND CRT ELECTRON GUN ADOPTING THE SAME

BACKGROUND OF THE INVENTION

The present invention relates to a cathode structure being an electron emitting source, and an electron gun adopting the same, for a cathode ray tube (CRT).

In general, a CRT is provided with a panel 100 having a fluorescent film 400 formed on the inner surface thereof, and a funnel 200 which is attached to the panel 100 and includes a neck portion 201 having an electron gun 300 installed therein, and a coned portion 202 having a deflection yoke 203 installed there around, as shown in FIG. 1. Reference numeral 301 denotes a support for supporting the electron gun 300.

In the CRT as constituted above, an electron beam emitted from the electron gun 300 is deflected by the deflection yoke 203 and projected onto the fluorescent film 400, thereby exciting a fluorescent material thereon to form an image.

The structure of the electron gun 300 installed in the neck portion 201 of the funnel 200 for emitting electrons is shown in FIG. 2. The electron gun 300 has a glass bead 11, a cathode structure 310 fixed to the bead glasses 11 for emitting an electron beam, a control electrode 14, a screen electrode 15, and a focus electrode 16 and a final accelerating electrode 17 which are sequentially installed from the screen electrodes 15 and form an electron lens.

Electrons are emitted from the cathode structure 310 by applying a predetermined voltage to each electrode and the cathode structure 310 of the thus-constituted electron gun 300, and electron lenses are formed between adjacent electrodes 14–17. Therefore, the electron beam emitted from the cathode structure 310 is focused and accelerated as it passes through the electron lenses.

The time required for normally emitting the electron beam from the electron gun 300 and the current density of the electron beam are determined by the cathode structure 310. The structure of the cathode structure 310 is shown in greater detail in FIG. 3. The cathode structure 310 has three cathode assemblies 12, an external case 13 fixed to the control electrodes 14 of FIG. 2, and an insulating body 28 within the external case 13 and through which the three cathode assemblies 12 are disposed.

Each cathode assembly 12 includes a cylindrical sleeve 21, a cap member 22 fixed to the end portion of the sleeve 21, an electron emitting material layer 23 coated on the upper surface of the cap member 22, and a holder 25 for supporting the lower part of the sleeve 21. Each cathode assembly 12 is fixed inside an internal case 26, and the insulating body 28 isolates the external case 13 from the internal case 26. In addition, the cathode assemblies 12 of FIG. 3 are of the indirect heating type, and a heater 24 is inserted in the sleeve 21. On the other hand, in a direct heating type cathode structure, a heater is directly connected to a cathode.

The heater 24 emits heat when a predetermined potential is applied to the heater 24 of the thus-emitted cathode structure 310. Heat emitted from the heater 24 is transferred to, thereby heating, the cap member 22, the sleeve 21, and the holder 25. If the cap member 22 is heated to, for example, about 800° C., electrons are emitted from the electron emitting material layer 23 coated on the upper surface of the cap member 22.

There are two types of electron emitting material layers: one is an oxide type obtained by coating a material containing an oxide of an alkali earth metal as a major component on a base metal containing a reducing material; and the other is an impregnation type obtained by impregnating an electron emitting material in the pores of a porous metal.

However, in a conventional cathode structure, since an electron emitting material is heated after a cap member and a sleeve are heated by a heater, a large amount of time is required for normal emission of electrons. Therefore, an extended period of time, generally 8–9 seconds, is needed to form an image on a screen of a CRT.

In addition, the cap member and the sleeve of the cathode structure are heated and then thermally expanded by the heater when they are operated, a convergence drift and a thermal drift in which the positions of electron beam shifts are generated. To prevent these drifts, electron beam emission aging should be performed during a manufacturing process, in which a cathode is heated for a long time so that the cathode has a physical and chemical structure more likely to emit electrons accurately. As a result, product yield is lowered.

In the case of a color CRT which excites red, blue, and green fluorescent material, a stabilization time for white balance is long due to the temporal differences among the initial thermal expansions of the cathode structure, the control electrodes, and the screen electrodes.

Furthermore, the conventional cathode structure consumes electric power, for example, 2–4 W, to heat the electron emitting material layer, and exhibits an electron emission characteristics distribution due to non-uniform heat transmission with respect to each of red, blue, and green cathodes.

In addition, since the heater and its support are included in the electron gun, the total length of the electron gun becomes large and a manufacturing process of the heater is very complicated, resulting in a decrease in product yield and an increase in failure rate.

SUMMARY OF THE INVENTION

The object of the present invention is to provide a cathode structure and a color CRT electron gun adopting the same, which reduce the time for forming an image on a screen and a stabilization time for white balance and are easy to fabricate, thereby increasing product yield.

To achieve the above object, there is provided a cathode structure comprising: an external case; an insulating member filled in the external case; a plurality of pins fixedly inserted into the insulating member and of which end portions extend from the upper surface of the insulating member; a field emission device (FED) unit attached on the insulating member; and a wire for electrically connecting the FED unit to the end portions of the pins.

The FED unit comprises: a substrate; three FEDs spaced by a predetermined distance on the substrate; and a plurality of terminals electrically connected to the FEDs to transfer power supplied from the wire.

According to another embodiment of the present invention, there is provided a cathode structure comprising: an external case having a buried portion which is buried in a glass bead of an electron gun; a retainer having an outer surface corresponding to the inner surface of the external case, and inserted into the external case; an FED unit inserted into the external case to be mounted on the retainer; and a conductive elastic member having a buried portion fixedly buried in the glass bead and a contact portion for elastically pressing against the upper surface of the FED unit in contact with the upper surface of the FED unit, for applying power to the FED unit.

According to another aspect of the present invention, there is provided an electron gun for a cathode ray tube (CRT) comprising: a cathode structure having an external case, an insulating member filled in the external case, a plurality of pins fixedly inserted into the insulating member and of which end portions extend from the upper surface of the insulating member, a field emission device (FED) unit attached on the insulating member, and a wire for electrically connecting the FED unit to the end portion s of the pins; and a focus electrode and a final accelerating electrode for focusing and accelerating an electron beam emitted from the cathode structure.

According to still another aspect of the present invention, there is provided an electron gun for a CRT comprising: a cathode structure having an external case having a buried portion which is buried in a glass bead of an electron gun, a retainer having an outer surface corresponding to the inner surface of the external case, and inserted into the external case, an FED unit inserted into the external case to be mounted on the retainer, and a conductive elastic member having a buried portion fixedly buried in said glass bead and a contact portion for elastically pressing against the upper surface of the FED unit in contact with the upper surface of the FED unit, for applying power to the FED unit; and a focus electrode and a final accelerating electrode for focusing and accelerating an electron beam emitted from the cathode structure.

BRIEF DESCRIPTION OF THE DRAWINGS

The above object and advantages of the present invention will become more apparent by describing in detail preferred embodiments thereof with reference to the attached drawings in which.

DETAILED DESCRIPTION OF THE INVENTION

Figure 1:
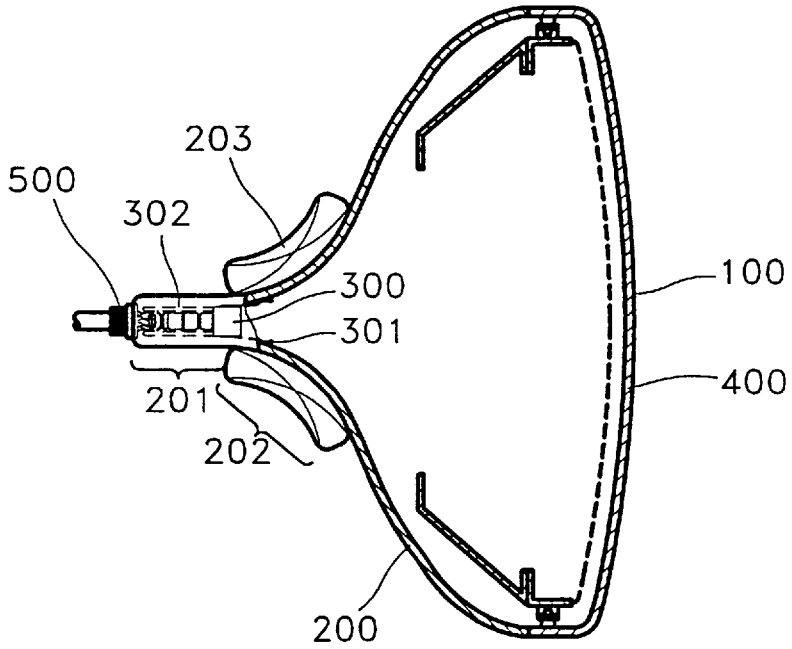
FIG. 1 is a sectional view of a general CRT.
Figure 2:
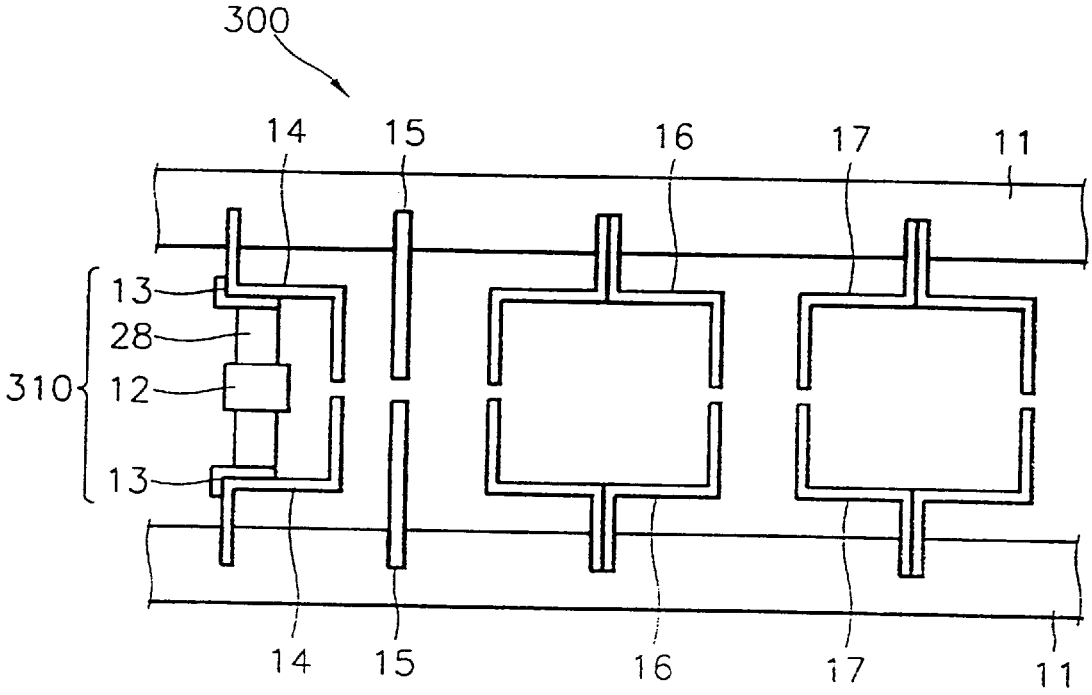
FIG. 2 (PRIOR ART)
FIG. 2 is a sectional view of an electron gun adopting a conventional cathode structure.
Figure 3:
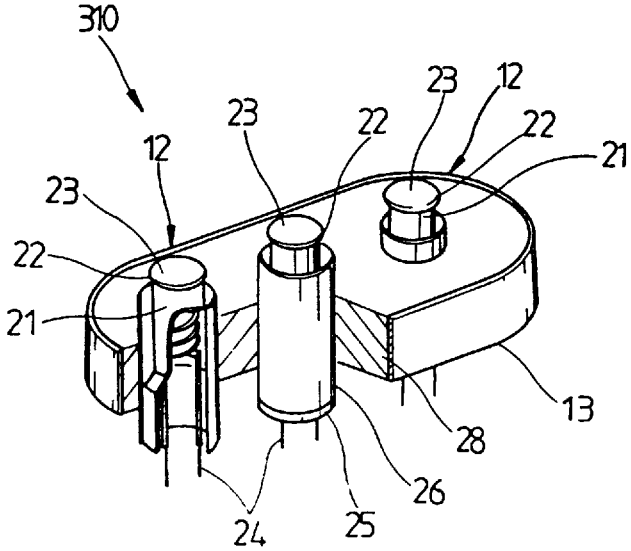
FIG. 3 (PRIOR ART)
FIG. 3 is a partially cutaway perspective view of the conventional cathode structure shown in FIG. 2.
Figure 4:
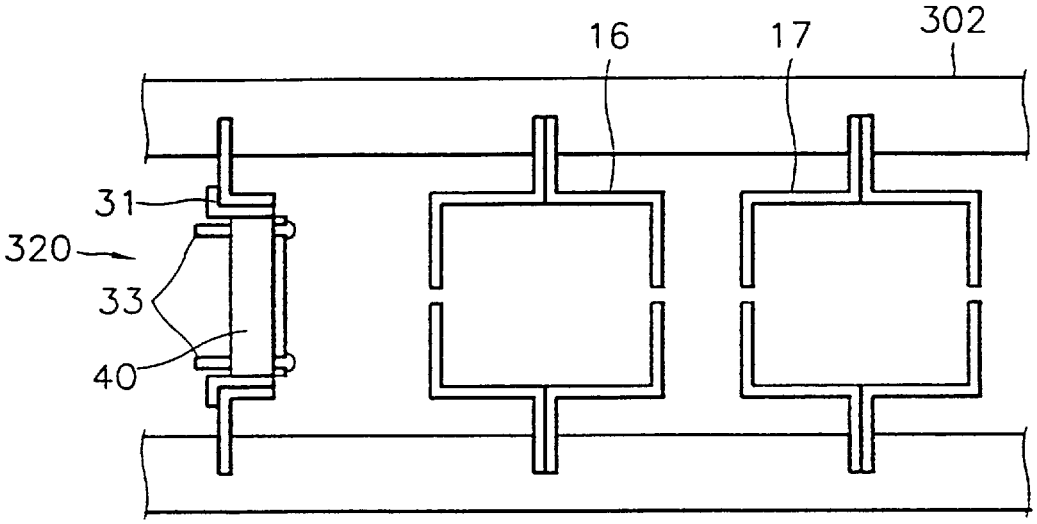
FIG. 4 is a sectional view of an electron gun adopting a cathode structure according to an embodiment of the present invention.

FIG. 4 illustrates a CRT electron gun adopting a cathode structure 320 according to a first embodiment of the present invention. Here, like reference numerals denote the same members as those of FIGS. 1, 2, and 3. As shown, the cathode structure 320 of the present invention is fixed to a glass bead 302. According to a characteristic of the present invention, the CRT electron gun uses a field emission device (FED) of a cool cathode type for emitting electrons by a field effect, as a cathode structure.

Figure 5:
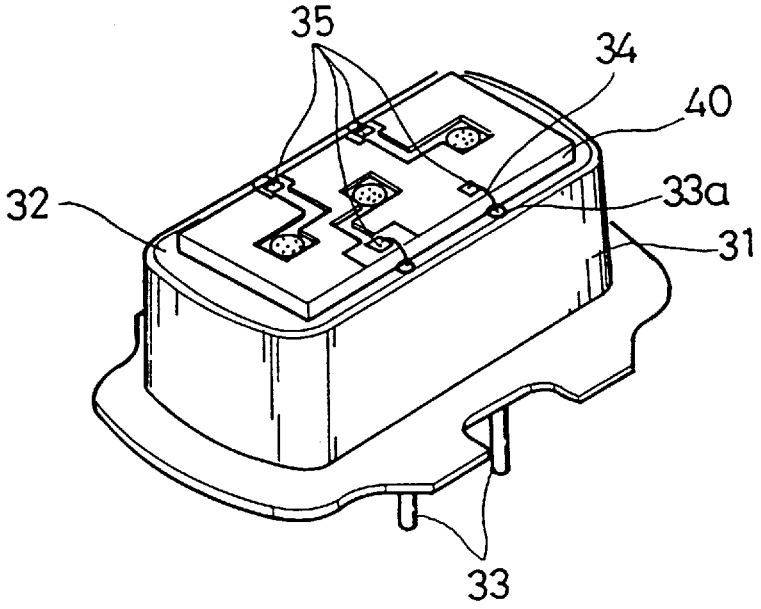
FIG. 5 is a perspective view of the cathode structure of the present invention shown in FIG. 4.

The cathode structure, referring to FIG. 5, has an external case 31 in the shape of a rim supportedly combined with the glass bead 302 of FIG. 4, an insulating member 32 filled in the external case 31, a plurality of pins 33 which are fixedly inserted into the insulating body 32 and of which the upper end portions 33*a* extend from the upper surface of the insulating body 32, an FED unit 40 attached on the upper surface of the insulating body 32, and wires 34 for connecting the end portions 33*a* of the pins 33 to terminals 35 of the FED unit 40 in order to supply a voltage to the FED unit 40. The wires 34 are approximately 10–50 $\mu$m in diameter and preferably manufactured by a wire boding process in semiconductor manufacture.

Figure 6:
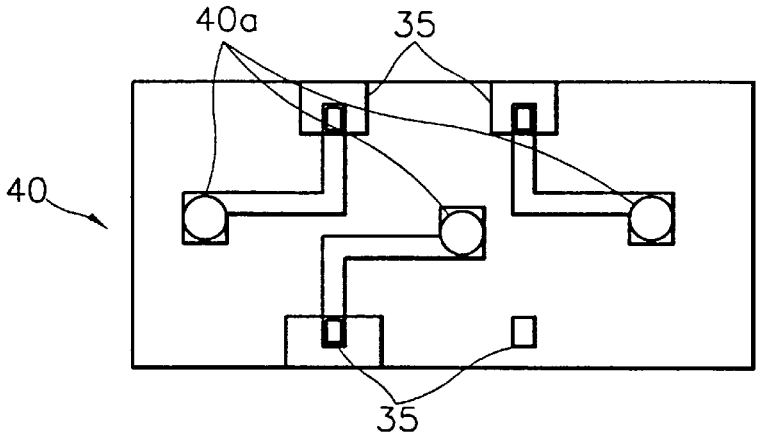
FIG. 6 is a plan view of the field emission device (FED) unit shown in FIG. 5.
Figure 7:
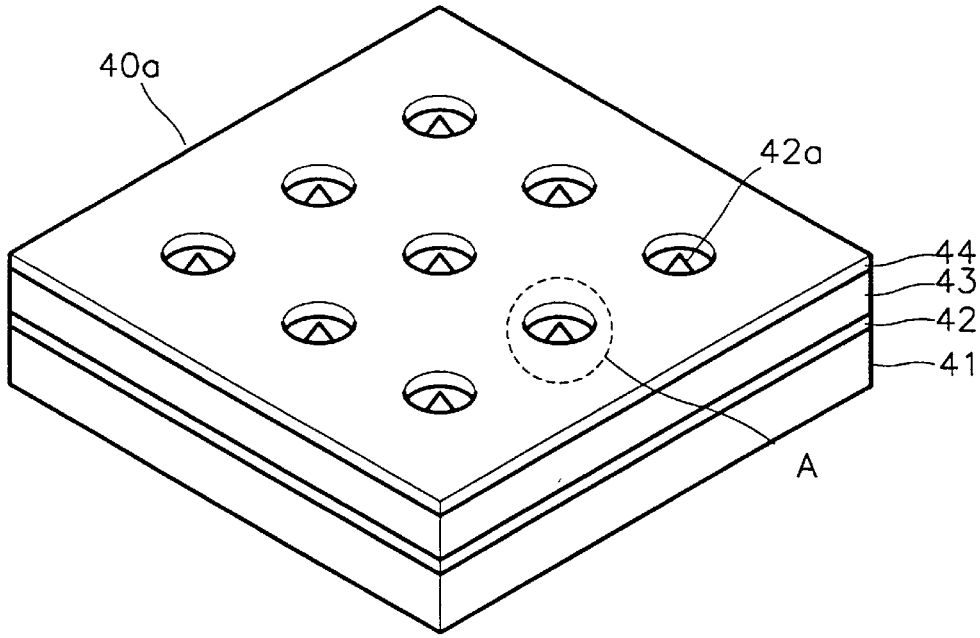
FIG. 7 is a magnified perspective view of the FED of FIG. 6.
Figure 8:
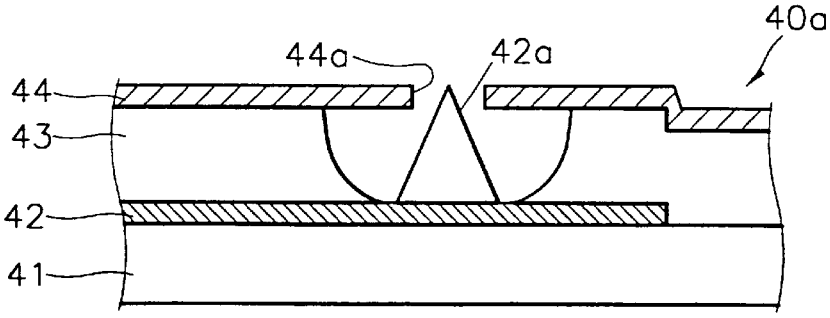
FIG. 8 is an extracted sectional view of portion "A" of FIG. 7.

As shown in FIG. 6, three FEDs 40*a* are arranged in a line in the FED unit 40. Referring to FIGS. 7 and 8, the FEDs 40*a* each have a silicon substrate 41, a cathode 42 formed on the upper surface of the substrate 41, a plurality of micro tips 42*a* arranged on the cathode 42 and containing molybdenum as a major component, an insulating layer 43 formed of $SiO_2$ and surrounding the micro-tips 42*a*, and a gate 44 formed on the upper surface of the insulating layer 43 and having openings 44*a* for exposing the micro-tips 42*a*. Since 50–100 nA is applied to each micro-tip 42*a* formed on the substrate 41, a 1 mA or larger current can be obtained with at least 10,000 micro-tips 42*a*. Therefore, enough current to excite a fluorescent film of a CRT can be obtained.

Referring to FIGS. 4–8, the operation of a CRT adopting the cathode structure as constituted above will be described. First, when a predetermined voltage is applied to the focus electrodes 16 and the final accelerating electrodes 17, electron lenses are formed between adjacent electrodes. In addition, when a predetermined voltage is applied to the micro-tips 42*a* of the FED unit 40 and the gate 44, an electrical field is generated between them, thereby emitting an electron beam from the micro-tips 42*a*. The emitted electron beam is focused and accelerated as it passes through the electron lenses formed between the above-described electrodes, deflected by the deflection yoke 203 of FIG. 1, and lands on the fluorescent film, thereby forming an image on the fluorescent film.

Figure 9:
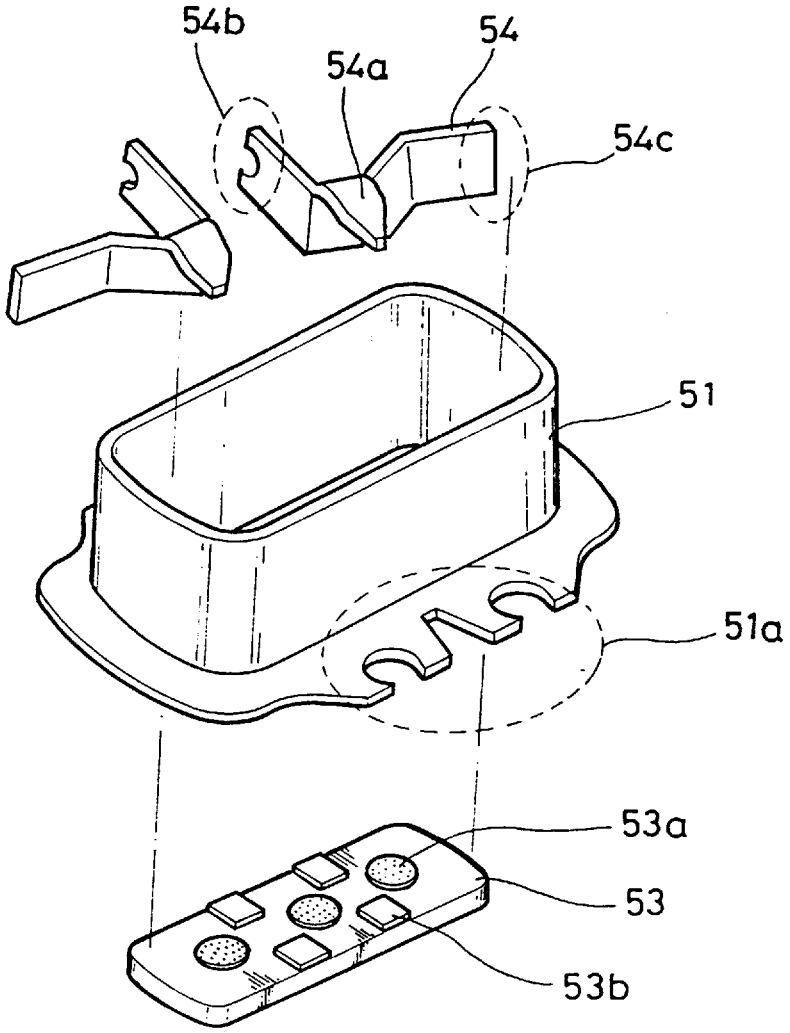
FIG. 9 is an exploded perspective view of a cathode structure according to another embodiment of the present invention.
Figure 10:
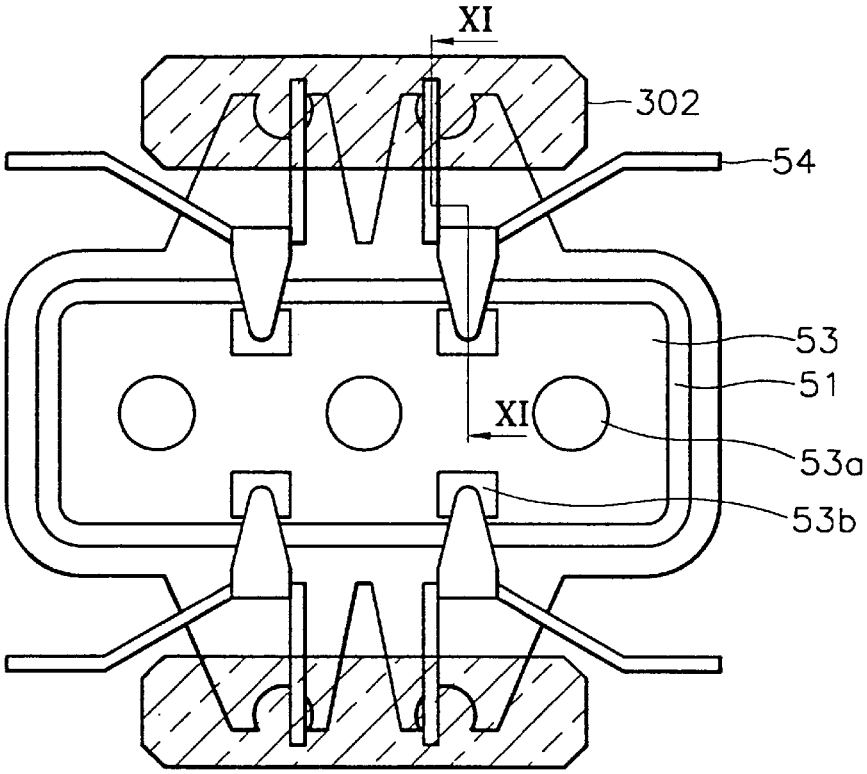
FIG. 10 is a plan view of the cathode structure of FIG. 9 combined with a bead glass.
Figure 11:
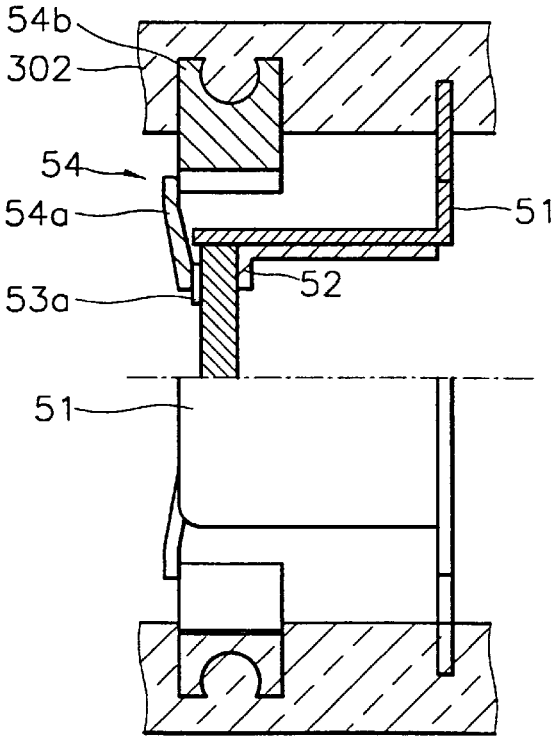
FIG. 11 is a side view of the cathode structure of FIG. 9 including the section taken along line XI—XI of FIG. 10.

A cathode structure according to a second embodiment of the present invention is illustrated in FIGS. 9–11. The cathode structure of the present embodiment has a rim-shaped external case 51, a retainer 52 inserted into the external case 51 and having an outer surface corresponding to the inner surface of the external case 51, an FED unit 53 attached on the retainer 52 which is placed in the external case 51, and conductive elastic members 54 for pressing against the upper surface of the FED unit 53. The external case 51 is formed of a metal and fixed by burying a buried portion 51*a* in the glass bead 302 of FIG. 10. The retainer 52 is inserted into the external case 51 and welded. FEDs 53*a* of the FED unit 53 to be mounted on the retainer 52 are of the same structure as those shown in FIGS. 7 and 8. In addition, the conductive elastic members 54 each have a buried portion 54*b* fixedly buried in the glass bead 302 and a contact portion 54*a* for pressing against terminals 53*b* of the FED unit 53 in contact with the pads 53*b*. The elastic members 54 are conductive and formed of an elastic material. There are four elastic members 54 corresponding to the four terminals 53*b* of the FED unit 53, though only two elastic members 54 are shown in FIG. 9. Thus, the elastic members 54 serve to apply a voltage to the FEDs 53*a* and fix the FED unit 53. Three of the terminals 53*b* are connected to the cathodes 42 of the FEDs 53*a*, shown in FIG. 8, and the other is connected to the gate 44. Therefore, a negative voltage is applied to the three terminals connected to the cathodes 42 of the FEDs 53*a* via external terminals 54*c* of the elastic members 54, and a gate voltage is applied to the terminal connected to the gate 44 via an external terminal 54*c*.

In addition, the buried portions 54*b* of the elastic members 54 are preferably parallel to the beam axis of the electron gun, as shown in FIG. 11. If the buried portions 54*b* are perpendicular to the beam axis of the electron gun, the distance between the buried portions 54*b* buried in a portion of a given width of the glass bead is two small, thus lowering the strength of the connection.

According to the cathode structure of this embodiment, since power is applied to the FED unit 53 whose terminals are connected to the elastic members 54 instead of the wires 34 of FIG. 5 in the first embodiment, there is no concern of damage to the FED unit 53 by a high voltage or external impact, and the assembly is simple.

The operation of the cathode structure and the CRT electron gun adopting the same according to this embodiment are the same as those in the first embodiment.

According to the cathode structure and the CRT electron gun of the present invention, since the moment a predetermined potential is applied to the cathode structure, electrons are emitted from micro-tips of the cathode structure, the time for normally emitting the electrons from the cathode structure can be reduced. Thus, the time required for forming an image on a screen of a CRT can also be reduced.

In addition, electron emission is realized by a field effect rather than heat, thereby preventing a thermal drift where components of a cathode structure thermally expand due to heating and thus the position of an electron beam shifts, and eliminating the need for power for heating a cathode. Furthermore, there is no electron emission characteristics distribution caused by non-uniform heat transmission with respect to each cathode.

In addition, in the case of a color CRT, a stabilization time for white balance is reduced, since, without heating cathodes, no thermal expansion of a cathode structure itself, control electrodes, and screen electrodes is generated.

In the electron gun adopting the cathode structure of the present invention, a heater for electron emission and its support, and control and screen electrodes are not necessary. Thus, the electron gun can be made small short and product miniaturization is possible.

As described above, the cathode structure and electron gun using the same are not limited to the above embodiments, and it is clearly understood that many variations are possible within the scope and spirit of the present invention by anyone skilled in the art.

What is claimed is:

1. A cathode structure comprising:

an external case;

an insulating member filled in said external case;

a plurality of pins fixedly inserted into said insulating member and of which end portions extend from an upper surface of said insulating member;

a field emission device (FED) unit attached on said insulating member; and a wire electrically connecting said FED unit to the end portions of said pins.

2. A cathode structure as claimed in claim 1, wherein said FED unit comprises:

a substrate;

three FEDs spaced by a predetermined distance on said substrate; and a plurality of terminals electrically connected to said FEDs to transfer power supplied from said wire.

3. A cathode structure as claimed in claim 1, wherein there are four terminals and four pins, three of said four terminals being connected to cathodes of said three FEDs, and the other terminal being connected to gates of said three FEDs.

4. An electron gun for a cathode ray tube (CRT) comprising:

a cathode structure having an external case, an insulating member filled in said external case, a plurality of pins fixedly inserted into said insulating member and of which end portions extend from an upper surface of said insulating member, a field emission device (FED) unit attached on said insulating member, and a wire electrically connecting said FED unit to the end portions of said pins; and a focus electrode and a final accelerating electrode for focusing and accelerating an electron beam emitted from said cathode structure.

5. An electron gun as claimed in claim 4, wherein said FED unit comprises:

a substrate;

three FEDs spaced apart by a predetermined distance on said substrate; and a plurality of terminals electrically connected to said FEDs to transfer power supplied from said wire.

6. An electron gun as claimed in claim 4, wherein there are four terminals and four pins, three of said four terminals being connected to cathodes of said three FEDs, and the other terminal being connected to gates of said three FEDs.

7. A cathode structure comprising:

an external case having a buried portion which is buried in a glass bead of an electron gun;

a retainer having an outer surface corresponding to the inner surface of said external case, and inserted into said external case;

an FED unit inserted into said external case to be mounted on said retainer; and a conductive elastic member having a buried portion fixedly buried in said glass bead and a contact portion for elastically pressing against an upper surface of said FED unit in contact with the upper surface of said FED unit, for applying power to said FED unit.

8. A cathode structure as claimed in claim 7, wherein said FED unit comprises:

a substrate;

three FEDs spaced apart by a predetermined distance on said substrate; and a plurality of terminals electrically connected to said FEDs to transfer power supplied from said conductive elastic member.

9. A cathode structure as claimed in claim 8, wherein there are four terminals, three of said four terminals being connected to cathodes of said three FEDs, and the other terminal being connected to gates of said three FEDs.

10. A cathode structure as claimed in claim 9, wherein said elastic member further comprises an external terminal for external electrical contact.

11. An electron gun for a CRT comprising:

a cathode structure having an external case having a buried portion which is buried in a glass bead of an electron gun, a retainer having an outer surface corresponding to the inner surface of said external case, and inserted into said external case, an FED unit inserted into said external case to be mounted on said retainer, and a conductive elastic member having a buried portion fixedly buried in said glass bead and a contact portion for elastically pressing against the upper surface of said FED unit in contact with the upper surface of said FED unit, for applying power to said FED unit; and a focus electrode and a final accelerating electrode for focusing and accelerating an electron beam emitted from said cathode structure.

12. An electron gun for a CRT as claimed in claim 11, wherein said FED unit comprises:

a substrate;

three FEDs spaced apart by a predetermined distance on said substrate; and a plurality of terminals electrically connected to said FEDs to transfer power supplied from said conductive elastic member.

13. An electron gun for a CRT as claimed in claim 12, wherein there are four terminals, three of said four terminals being connected to cathodes of said three FEDs, and the other terminal being connected to gates of said three FEDs.

14. An electron gun for a CRT as claimed in claim 13, wherein said elastic member further comprises an external terminal for external electrical contact.

* * * * *